US008586853B2

(12) United States Patent
Sakazaki

(10) Patent No.: US 8,586,853 B2
(45) Date of Patent: Nov. 19, 2013

(54) PERFORMANCE APPARATUS AND ELECTRONIC MUSICAL INSTRUMENT

(75) Inventor: Naoyuki Sakazaki, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 72 days.

(21) Appl. No.: 13/306,257

(22) Filed: Nov. 29, 2011

(65) Prior Publication Data

US 2012/0137858 A1 Jun. 7, 2012

(30) Foreign Application Priority Data

Dec. 1, 2010 (JP) ..... 2010-268067

(51) Int. Cl.
*G10H 1/32* (2006.01)
*G10H 3/00* (2006.01)

(52) U.S. Cl.
USPC ..... 84/743; 84/725; 84/741

(58) Field of Classification Search
USPC ..... 84/615, 626, 653, 662, 743
See application file for complete search history.

(56) References Cited

U.S. PATENT DOCUMENTS

| | | | | |
|---|---|---|---|---|
| 5,017,770 | A * | 5/1991 | Sigalov | 250/221 |
| 5,058,480 | A * | 10/1991 | Suzuki et al. | 84/600 |
| 5,081,896 | A * | 1/1992 | Hiyoshi et al. | 84/600 |
| 5,369,270 | A * | 11/1994 | Gurner et al. | 250/221 |
| 5,475,214 | A * | 12/1995 | DeFranco et al. | 250/221 |
| 5,648,627 | A * | 7/1997 | Usa | 84/600 |
| 5,663,514 | A * | 9/1997 | Usa | 84/600 |
| 6,388,183 | B1 * | 5/2002 | Leh | 84/645 |
| 6,492,775 | B2 * | 12/2002 | Klotz et al. | 315/120 |
| 6,919,503 | B2 * | 7/2005 | Nishitani et al. | 84/633 |
| 6,960,715 | B2 * | 11/2005 | Riopelle | 84/725 |
| 7,723,604 | B2 * | 5/2010 | Bang et al. | 84/615 |
| 7,807,913 | B2 * | 10/2010 | Choi et al. | 84/600 |

FOREIGN PATENT DOCUMENTS

| | | | |
|---|---|---|---|
| JP | 2663503 | B2 | 10/1997 |
| JP | 2000-285248 | A | 10/2000 |
| JP | 2004-235814 | A | 8/2004 |
| JP | 2005-122238 | A | 5/2005 |
| JP | 2006-162904 | A | 6/2006 |
| JP | 2006-174856 | A | 7/2006 |

(Continued)

OTHER PUBLICATIONS

Japanese Office Action dated Oct. 2, 2012 (and English translation thereof) in counterpart Japanese Application No. 2010-268067.

(Continued)

*Primary Examiner* — Jeffrey Donels
(74) *Attorney, Agent, or Firm* — Holtz, Holtz, Goodman & Chick, PC

(57) ABSTRACT

A performance apparatus 11 extends in its longitudinal direction to be held by a player with his or her hand. The performance apparatus is provided with a geomagnetic sensor 22 and an acceleration sensor 23 in its extending portion. CPU 21 gives an instruction to an electronic musical instrument 19 to generate a musical tone of a tone color at a timing when a position of the performance apparatus obtained by the geomagnetic sensor and acceleration sensor passes through a sound generation area defined in space, wherein the tone color of the musical tone corresponds to the sound generation area. The sound generation areas and corresponding tone colors are stored in an area/tone color table in RAM 26. Upon receipt of an instruction, the electronic musical instrument generates a musical tone having a tone color corresponding to the sound generation area.

7 Claims, 17 Drawing Sheets

(56) References Cited

FOREIGN PATENT DOCUMENTS

| | | | |
|---|---|---|---|
| JP | 2006-220938 | A | 8/2006 |
| JP | 2007-133531 | A | 5/2007 |
| JP | 2007-256736 | A | 10/2007 |
| JP | 2010-020140 | A | 1/2010 |
| JP | 2010-124396 | A | 6/2010 |
| JP | 2011-128427 | A | 6/2011 |

OTHER PUBLICATIONS

Japanese Office Action dated Apr. 9, 2013 (and English translation thereof) in counterpart Japanese Application No. 2010-268067.

* cited by examiner

FIG. 8

800

801

| AREA ID | CENTER POSITION C | PASSING-THROUGH POSITION P | RADIUS | TONE COLOR |
|---|---|---|---|---|
| 0 | $(x_{c0}, y_{c0}, z_{c0})$ | $(x_{p0}, y_{p0}, z_{p0})$ | $d_0$ | TOMS |
| 1 | $(x_{c1}, y_{c1}, z_{c1})$ | $(x_{p1}, y_{p1}, z_{p1})$ | $d_1$ | SNARE |
| 2 | $(x_{c2}, y_{c2}, z_{c2})$ | $(x_{p2}, y_{p2}, z_{p2})$ | $d_2$ | CYMBAL |
| 3 | $(x_{c3}, y_{c3}, z_{c3})$ | $(x_{p3}, y_{p3}, z_{p3})$ | $d_3$ | HI-HAT |
| ⋮ | ⋮ | ⋮ | ⋮ | ⋮ |

PERFORMANCE APPARATUS AND ELECTRONIC MUSICAL INSTRUMENT

CROSS-REFERENCE TO RELATED APPLICATIONS

The present application is based upon and claims the benefit of priority from the prior Japanese Patent Application No. 2010-268067, filed Nov. 1, 2010, and the entire contents of which are incorporated herein by reference.

BACKGROUND OF THE INVENTION

1. Field of the Invention

The present invention relates to a performance apparatus and an electronic musical instrument, which generate musical tones, when held and swung by a player with his or her hand.

2. Description of the Related Art

An electronic musical instrument has been proposed, which is provided with an elongated member of a stick type with a sensor installed thereon, and generates musical tones when the sensor detects a movement of the elongated member. Particularly, in the electronic musical instrument, the elongated member of a stick type has a shape of a drumstick and is constructed so as to generate musical tones as if percussion instruments generate sounds in response to player's motion of striking drums and/or Japanese drums.

For instance, U.S. Pat. No. 5,058,480 discloses a performance apparatus, which has an acceleration sensor installed in its stick-type member, and generates a musical tone when a certain period of time has lapsed after an output (acceleration sensor value) from the acceleration sensor reaches a predetermined threshold value.

But in the performance apparatus disclosed in U.S. Pat. No. 5,058,480, generation of musical tones is simply controlled based on the acceleration sensor values of the stick-type member and therefore, the performance apparatus has a drawback that it is not easy for a player to change musical tones as he or she desires.

Further, Japanese Patent No. 2007-256736 A discloses an apparatus, which is capable of generating musical tones having plural tone colors. The apparatus is provided with a geomagnetic sensor and detects an orientation of a stick-type member held by the player based on a sensor value obtained by the geomagnetic sensor. The apparatus selects one from among plural tone colors of a musical tone to be generated, based on the detected orientation of the stick-type member. In the apparatus disclosed in Japanese Patent No. 2007-256736A, since the tone color of musical tone is changed based on the direction in which the stick-type member is swung by the player, it is required to assign various directions in which the stick-type member is to be swung to generate various tone colors of musical tones. In the apparatus, as tone colors of musical tones to be generated increase, an angle range in which the stick-type member is swung to generate such tone color become narrower, and therefore it is hard to generate musical tones of a tone color desired by the player.

SUMMARY OF THE INVENTION

The present invention has an object to provide a performance apparatus and an electronic musical instrument, which allow the player to change musical tone elements including tone colors, as he or she desires.

According to one aspect of the invention, there is provided a performance apparatus, which comprises a holding member held by a player with his or her hand, a musical-tone generating unit for generating musical tones, an area/parameter storing unit for storing information for specifying plural sound generation areas defined in space and parameters of musical tones corresponding respectively to the plural sound generation areas, a position-information obtaining unit for successively obtaining position information of the holding member, a sound-generation detecting unit for detecting whether or not the position information of the holding member obtained by the position-information obtaining unit is included in any of the plural sound generation areas specified by the information stored in the area/parameter storing unit, a reading unit for reading from the area/parameter storing unit the parameter corresponding to the sound generation area, in which the sound-generation detecting unit determines the position information of the holding member is included, and an instructing unit for giving an instruction to the musical-tone generating unit to generate a musical tone specified by the parameter read by the reading unit at a timing of sound generation, wherein the timing of sound generation is set to a time when the sound-generation detecting unit has detected that the position information of the holding member is included in the sound generation area.

According to one aspect of the invention, there is provided an electronic musical instrument, which comprises a performance apparatus and a musical instrument unit having a musical-tone generating unit for generating musical tones, wherein the performance apparatus comprises a holding member held by a player, an area/parameter storing unit for storing information for specifying plural sound generation areas defined in space and parameters of musical tones corresponding respectively to the plural sound generation areas, a position-information obtaining unit for successively obtaining position information of the holding member, a sound-generation detecting unit for detecting whether or not the position information of the holding member obtained by the position-information obtaining unit is included in any of the plural sound generation areas specified by the information stored in the area/parameter storing unit, a reading unit for reading from the area/parameter storing unit the parameter corresponding to the sound generation area, in which the sound-generation detecting unit determines the position information of the holding member is included, and an instructing unit for giving an instruction to the musical-tone generating unit to generate a musical tone specified by the parameter read by the reading unit at a timing of sound generation detected by the sound-generation detecting unit, wherein the timing of sound generation is set to a time when the sound-generation detecting unit has detected that the position information of the holding member is included in the sound generation area, and wherein both the performance apparatus and the musical instrument unit comprise communication units, respectively.

BRIEF DESCRIPTION OF THE DRAWINGS

FIG. 8 is a view illustrating an example of an area/tone color table stored in RAM in the first embodiment of the invention.

DETAILED DESCRIPTION OF THE PREFERRED EMBODIMENTS

Figure 1:
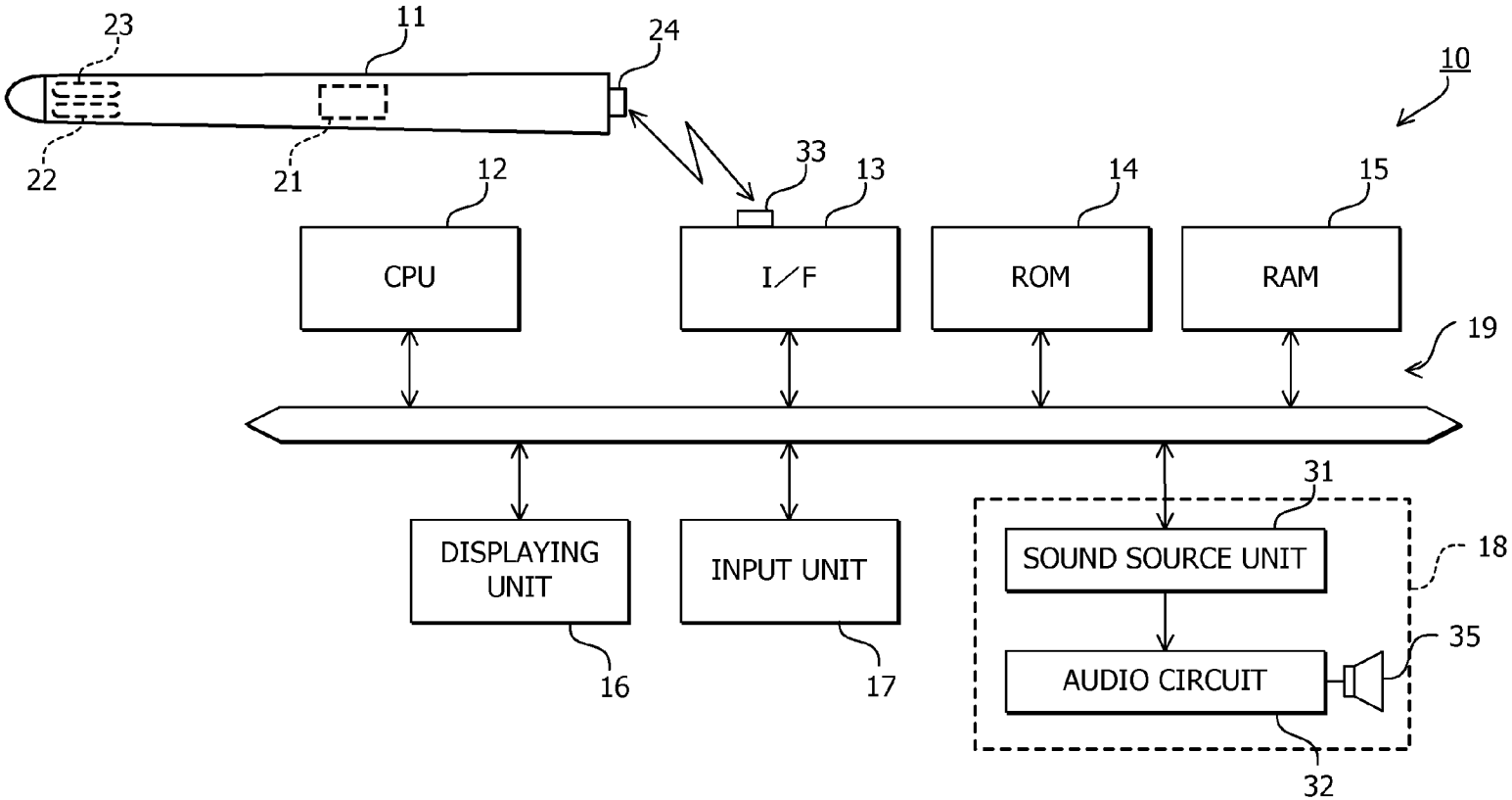
FIG. 1 is a block diagram of a configuration of an electronic musical instrument according to the first embodiment of the invention.

Now, embodiments of the present invention will be described with reference to the accompanying drawings in detail. FIG. 1 is a block diagram of a configuration of an electronic musical instrument according to the first embodiment of the invention. As shown in FIG. 1, the electronic musical instrument 10 according to the first embodiment has a stick-type performance apparatus 11, which extends in its longitudinal direction to be held or gripped by a player with his or her hand. The performance apparatus 11 is held or gripped by the player to be swung. The electronic musical instrument 10 is provided with a musical instrument unit 19 for generating musical tones. The musical instrument unit 19 comprises CPU 12, an interface (I/F) 13, ROM 14, RAM 15, a displaying unit 16, an input unit 17 and a sound system. 18. As will be described in detail later, the performance apparatus 11 has an acceleration sensor 23 and a geomagnetic sensor 22 provided around in a head portion opposite to a base portion of the elongated performance apparatus 11. The player grips or holds the base portion to swing the elongated performance apparatus 11.

The I/F 13 of the musical instrument unit 19 serves to receive data (for instance, a note-on event) from the performance apparatus 11. The data received through I/F 13 is stored in RAM 15 and notice of receipt of such data is given to CPU 12. In the present embodiment, the performance apparatus 11 is equipped with an infrared communication device 24 at the edge of the base portion and I/F 13 of the musical instrument unit 19 is also equipped with an infrared communication device 33. Therefore, the musical instrument unit 19 receives infrared light generated by the infrared communication device of the performance device 11 through the infrared communication device 33 of I/F 13, thereby receiving data from the performance apparatus 11.

CPU 12 controls whole operation of the electronic musical instrument 10. In particular, CPU 12 serves to perform various processes including a controlling operation of the musical instrument unit 19, a detecting operation of a manipulated state of key switches (not shown) in the input unit 17 and a generating operation of musical tones based on note-on events received through I/F 13.

ROM 14 stores various programs for executing various processes, including a process for controlling the whole operation of the electronic musical instrument 10, a process for controlling the operation of the musical instrument unit 19, a process for detecting the operated state of the key switches (not shown) in the input unit 17, and a process for generating musical tones based on the note-on events received through I/F 13. ROM 14 has a waveform-data area for storing waveform data of various tone colors, in particular, including waveform data of percussion instruments such as bass drums, high-hats, snare drums and cymbals. The waveform data to be stored in ROM 14 is not limited to the waveform data of the percussion instruments, but waveform data of wind instruments such as flutes, saxes and trumpets, waveform data of keyboard instruments such as pianos, and waveform data of string instruments such as guitars can be stored in ROM 14.

RAM 15 serves to store programs read from ROM 14 and to store data and parameters generated during the course of the executed process. The data generated in the process includes the manipulated state of the switches in the input unit 17, sensor values and generated-sound states (sound-generation flag) received through I/F 13.

The displaying unit 16 has, for example, a liquid crystal displaying device (not shown) and is able to display a selected tone color and contents of an area/tone color table to be described later. In the area/tone color table, sound generation areas are associated with tone colors. The input unit 17 has various switches (not shown) and is used to specify a tone color of musical tones to be generated.

The sound system 18 comprises a sound source unit 31, an audio circuit 32 and a speaker 35. Upon receipt of an instruction from CPU 12, the sound source unit 31 reads waveform data from the waveform-data area of ROM 14 to generate and output musical tone data. The audio circuit 32 converts the musical tone data supplied from the sound source unit 31 into an analog signal and amplifies the analog signal to output the amplified signal through the speaker 35, whereby a musical tone is output from the speaker 35.

Figure 2:
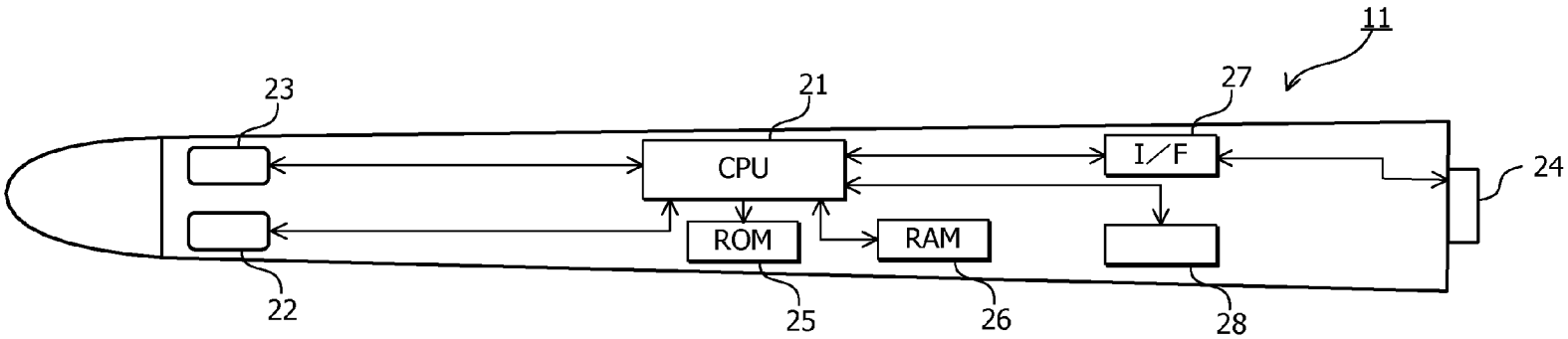
FIG. 2 is a block diagram of a configuration of a performance apparatus according to the first embodiment of the invention.

FIG. 2 is a block diagram of a configuration of the performance apparatus 11 in the first embodiment of the invention. As shown in FIG. 2, the performance apparatus 11 is equipped with the geomagnetic sensor 22 and the acceleration sensor 23 in the head portion opposite to the base portion. The position where the geomagnetic sensor 22 to be mounted on is not limited to the head portion, but the geomagnetic sensor 22 may be mounted on the base portion. Taking the head of the performance apparatus 11 as the reference (that is, keeping eyes on the head of the performance apparatus 11), the player often swings the performance apparatus 11. Therefore, since it is taken into consideration that information of the head position of the performance apparatus 11 is obtained, it is preferable for the geomagnetic sensor 22 to be mounted on the head portion of the performance apparatus 11.

The geomagnetic sensor 22 has a magnetic-resistance effect element and/or a hole element, and is a tri-axial geomagnetic sensor, which is able to detect magnetic components respectively in the X-, Y- and Z-directions. In the first embodiment of the invention, the position information (coordinate value) of the performance apparatus 11 is obtained from the sensor values of the tri-axial geomagnetic sensor. Meanwhile, the acceleration sensor 23 is a sensor of a capacitance type and/or of a piezo-resistance type. The acceleration sensor 23 is able to output a data value representing an acceleration sensor value in the axial direction of the performance apparatus 11.

The performance apparatus 11 comprises CPU 21, the infrared communication device 24, ROM 25, RAM 26, an interface (I/F) 27 and an input unit 28. CPU 21 performs various processes such as a process of obtaining the sensor values in the performance apparatus 11, a process of obtaining the position information in accordance with the sensor values of the geomagnetic sensor 22 and the acceleration sensor 23, a process of setting a sound generation area for defining a sound-generation timing, a process of detecting a sound-generation timing of a musical tone based on the position information, a process of generating a note-on event, and a process of controlling a transferring operation of the note-on event through I/F 27 and the infrared communication device 24.

ROM 25 stores various process programs for obtaining the sensor values in the performance apparatus 11, obtaining the position information in accordance with the sensor values of the geomagnetic sensor 22 and the acceleration sensor 23, setting a sound generation area for defining a sound-generation timing, detecting a sound-generation timing of a musical tone based on the position information, generating a note-on event, and controlling the transferring operation of the note-on event through I/F 27 and the infrared communication device 24. RAM 26 stores values generated and/or obtained in the process such as the sensor values. In accordance with an instruction from CPU 21, data is supplied to the infrared communication device 24 through I/F 27. The input unit 28 has various switches (not shown).

Figure 3:
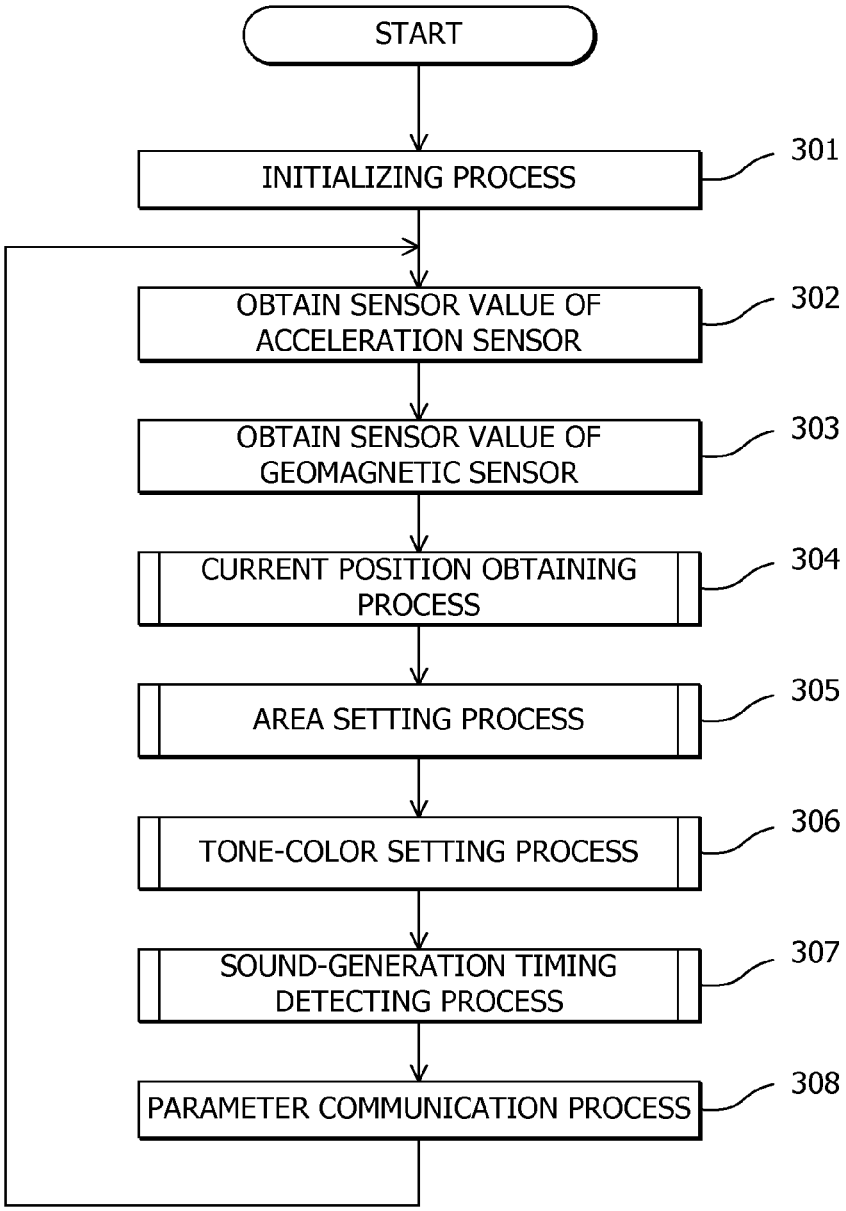
FIG. 3 is a flow chart of an example of a process performed in the performance apparatus according to the first embodiment of the invention.

FIG. 3 is a flow chart of an example of a process to be performed in the performance apparatus 11 according to the first embodiment of the invention. CPU 21 of the performance apparatus 11 performs an initializing process at step 301, clearing data in RAM 26. In the initializing process, a timer interrupt is released. When the timer interrupt is released, CPU 21 of the performance apparatus 11 reads the sensor values of the geomagnetic sensor 22 and the acceleration sensor 23, and stores the read sensor values in RAM 26. Further, in the initializing process, the initial position of the performance apparatus 11 is obtained based on the initial values the geomagnetic sensor 22 and the acceleration sensor 23, and stored in RAM 26. In the following description, a current position of the performance apparatus 11, which is obtained in a current position obtaining process (step 304), is a position relative to the above initial position. After the initializing process at step 301, the processes at step 302 to step 308 are repeatedly performed.

CPU 21 obtains and stores in RAM 26 the sensor value (acceleration sensor value) of the acceleration sensor 23, which has been obtained in the interrupt process (step 302). Further, CPU 21 obtains the sensor value (geomagnetic sensor value) of the geomagnetic sensor 22, which has been obtained in the interrupt process (step 303).

Figure 4:
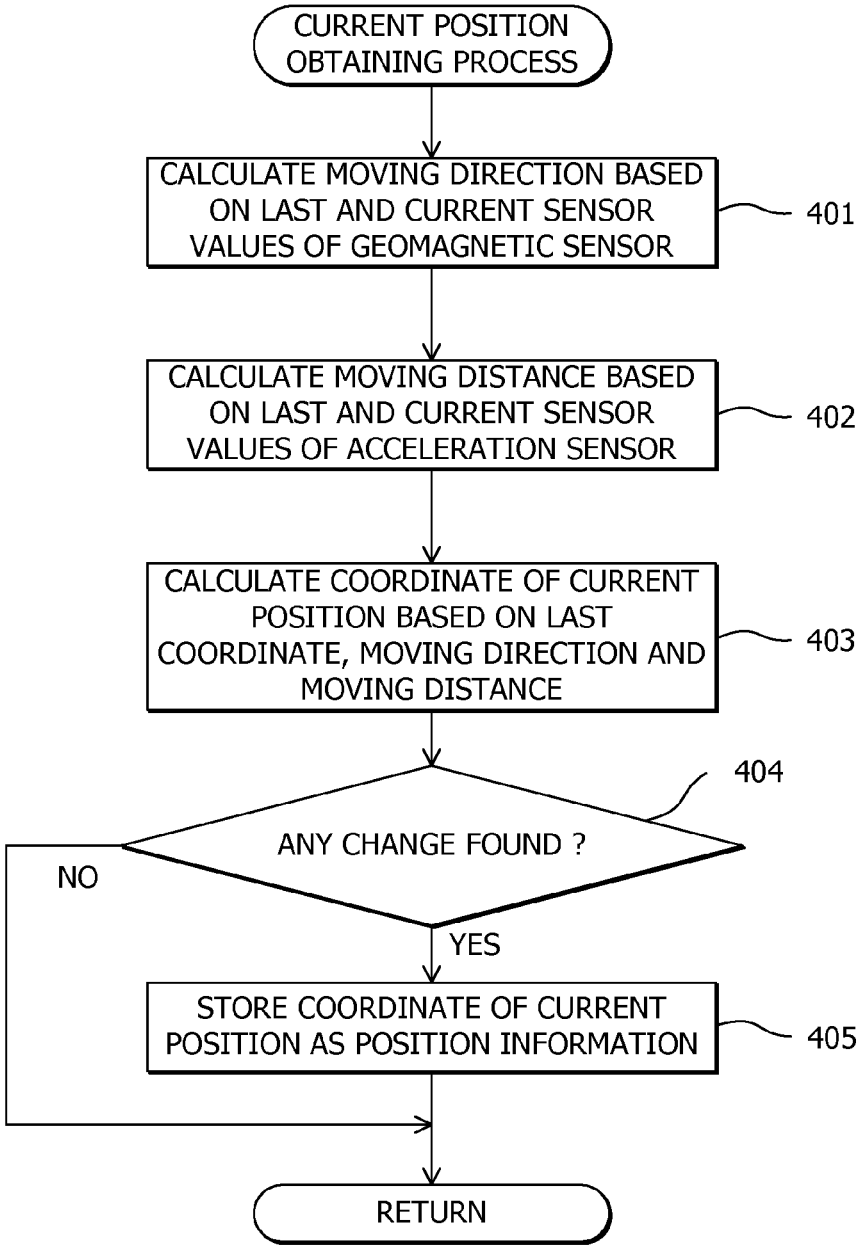
FIG. 4 is a flow chart showing an example of a current position obtaining process performed in the performance apparatus according to the first embodiment of the invention.

Then, CPU 21 performs the current position obtaining process at step 304. FIG. 4 is a flow chart showing an example of the current position obtaining process to be performed in the performance apparatus 11 according to the first embodiment of the invention. Based on the geomagnetic sensor value, which was obtained and stored in RAM. 26 in the process performed last time at step 303 and the geomagnetic sensor value currently obtained at step 303, CPU 21 calculates a moving direction of the performance apparatus 11 (step 401). As described above, since the geomagnetic sensor 22 in the present embodiment is the tri-axial magnetic sensor, the geomagnetic sensor 22 is able to calculate the direction based on a three-dimensional vector consisting of differences among components along the X-, Y-, and Z-directions.

Further, using the acceleration sensor value, which was obtained and stored in RAM. 26 in the process performed last time at step 302 and the acceleration sensor value currently obtained at step 302, CPU 21 calculates a moving distance of the performance apparatus 11 (step 402). The moving distance is found by performing integration twice using the acceleration sensor values and a time difference (time interval) between the time at which the former sensor value was obtained and the time at which the latter sensor value is obtained. Then, CPU 21 calculates the coordinate of the current position of the performance apparatus 11, using the last position information stored in RAM 26, and the moving direction and the moving distance calculated respectively at steps 401 and 402 (step 403).

CPU 21 judges at step 404 whether or not any change has been found between the current coordinate of the position and the previous coordinate of the position. When it is determined YES at step 404, CPU 21 stores in RAM 26 the calculated coordinate of the current position as new position information (step 405).

Figure 5:
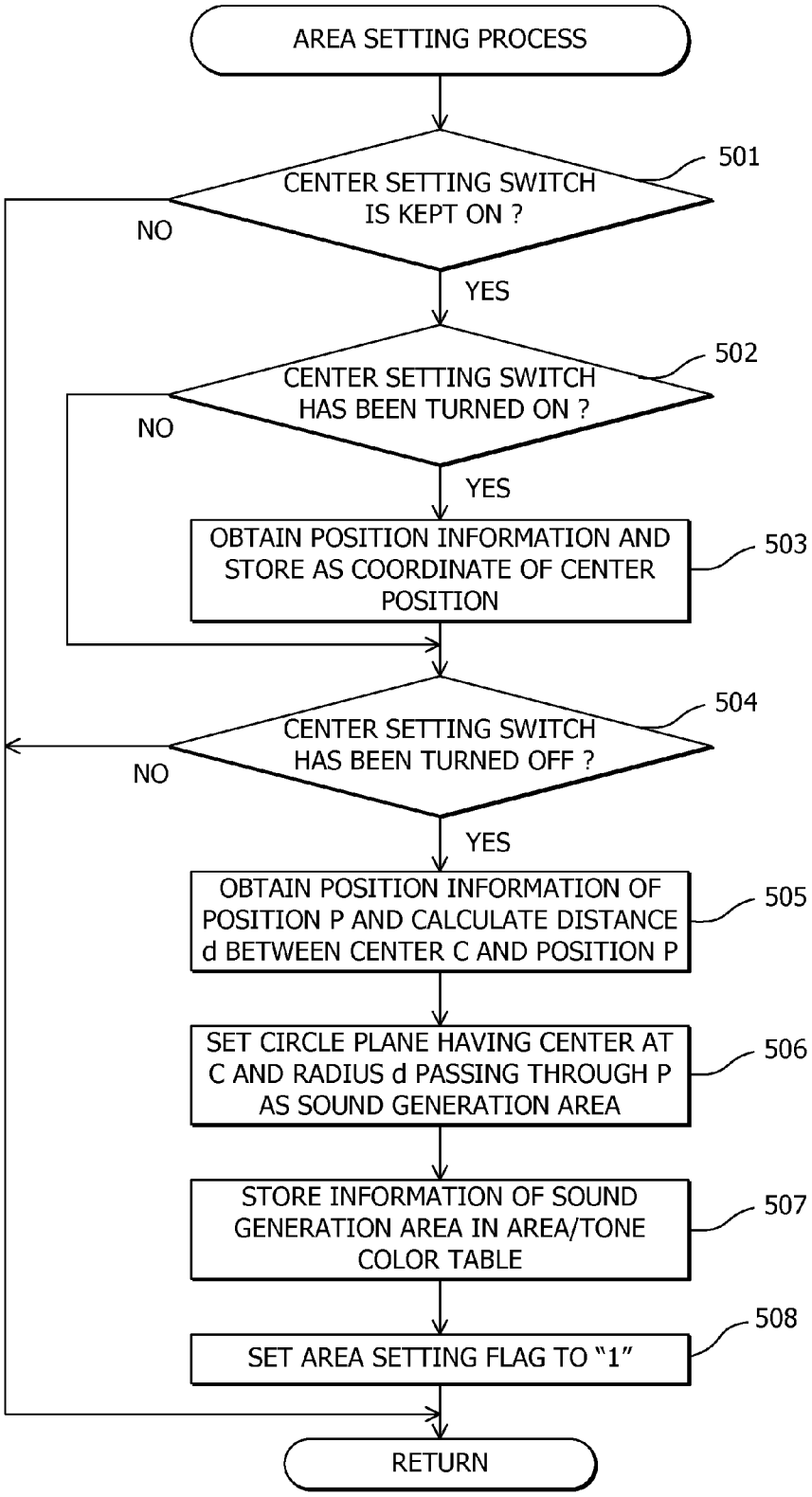
FIG. 5 is a flow chart showing an example of an area setting process performed in the performance apparatus according to the first embodiment of the invention.

After the current position obtaining process at step 304, CPU 21 performs an area setting process at step 305. FIG. 5 is a flowchart showing an example of the area setting process to be performed in the performance apparatus 11 according to the first embodiment of the invention. CPU 21 judges at step 501 whether or not a center setting switch in the input unit 28 of the performance apparatus 11 is kept on on. When it is determined NO at step 501, the area setting process finishes. When it is determined YES at step 501, CPU 21 judges at step 502 whether or not the center setting switch has been turned on. When it is determined YES at step 502, CPU 21 obtains the position information from RAM 26 and stores the obtained position information as the position information (coordinate ($x_c$, $y_c$, $z_c$)) of the center position C in RAM 26 (step 503). This position is used as the reference position for the sound generation areas to be set hereinafter.

When it is determined YES at step 502, that is, when the center setting switch is kept on, or when the information of the center position has been stored in RAM 26 at step 503, CPU 21 judges at step 504 whether or not the center setting switch has been turned off. When it is determined NO at step 504, the area setting process finishes. When it is determined YES at step 504, CPU 21 obtains the position information from RAM 26 and stores the obtained position information as the position information (coordinate ($x_p$, $y_p$, $z_p$)) of the position P of the performance apparatus 11 in RAM 26 (step 505). Further, CPU 21 calculates a distance $d_p$ between the position C and the position P (step 505). CPU 21 sets a circle as the sound generation area, which circle has the center at the position C, and is defined by a radius $d_p$ passing through the position P (step 506). CPU 21 stores information for specifying the sound generation area in an area/tone color table in RAM 26 (step 507), wherein the information specifying the sound generation area contains the coordinates of the center position C and the passing-through position P, and radius d. Thereafter, CPU 21 sets an area setting flag in RAM 26 to "1" (step 508).

As described above, in the first embodiment of the invention, the player can set the sound generation area in the following manner, that is, the player turns on the setting switch of the performance apparatus 11 at the position set as the center position C, and moves the performance apparatus 11 to the position corresponding to a radius with the setting switch kept turned on, and then the player turns the setting switch off at such position, whereby a plane of a circle is set as the sound generation area, which plane has the center position C at the position where the setting switch is turned on and has the radius d passing through the position P, where the setting switch is turned off, wherein the radius d is a distance between the center position C and the position P.

Figure 7:
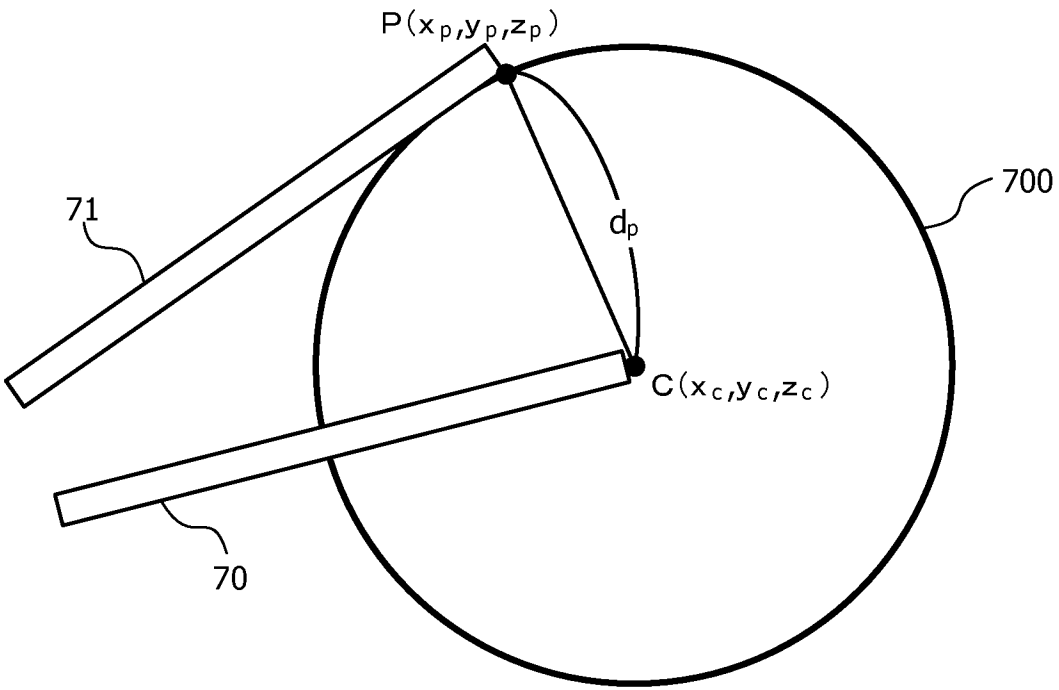
FIG. 7 is a view schematically showing decision of the sound generation area in the first embodiment of the invention.

FIG. 7 is a view schematically showing decision of the sound generation area in the first embodiment of the invention. A reference numeral 70 denotes the performance apparatus, which is kept at the position at the time when the center setting switch has been turned on. Meanwhile, a reference numeral 71 denotes the performance apparatus, which is kept at the position at the time when the center setting switch has been turned off. For convenience sake, FIG. 7 illustrates the performance apparatus 11 seen from the top, which apparatus is moved in an imaginary horizontal plane by the player.

When the player turns on the center setting switch of the performance apparatus 70, the position of the head of the performance apparatus 70 is stored in RAM 26 as the coordinate $(x_c, y_c, z_c)$ of the center position C, and when the player moves the performance apparatus to his or her desired position with the center setting switch kept turned on, and turns the switch off at such position, then the position of the head of the performance apparatus 71 is obtained as the coordinate $(x_p, y_p, z_p)$ of the position P, and the distance $d_p$ between the center position C and the position P is calculated. In this manner, a plane of a circle 700 having the center at the center position C and the radius $d_p$ passing through the position P is set as the sound generation area. As will be described later, when the head (geomagnetic sensor 22) of the performance apparatus 11 is placed within the sound generation area, or when the head (geomagnetic sensor 22) of the performance apparatus 11 runs through the sound generation area, a musical tone will be generated.

In the example shown in FIG. 7, the player moves the performance apparatus 11 horizontally, and the plane of a circle is prepared in parallel with the surface of the ground. The plane of a circle is not limited to the example of FIG. 7, but may be set with an arbitrary angle to the surface of the ground. To set the sound generation area, another method can be employed, and this method will be described later.

Figure 6:
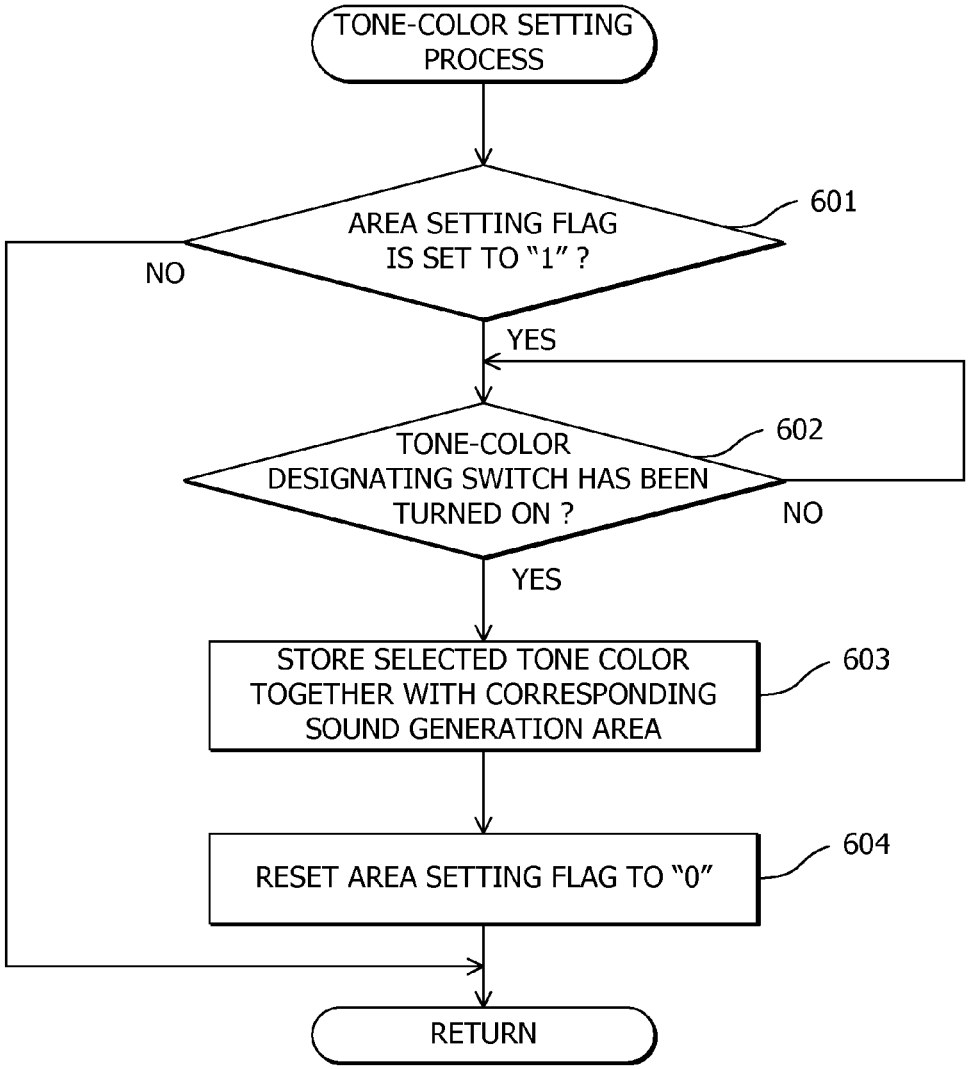
FIG. 6 is a flowchart showing an example of a tone-color setting process performed in the performance apparatus according to the first embodiment of the invention.

After the area setting process has finished at step 305, CPU 21 performs a tone-color setting process at step 306. FIG. 6 is a flow chart showing an example of the tone-color setting process to be performed in the performance apparatus 11 according to the first embodiment of the invention. CPU 21 judges at step 601 if the area setting flag has been set to "1". When it is determined NO at step 601, then the tone-color setting process finishes.

When it is determined YES at step 601, CPU 21 judges at step 602 if a tone-color designating switch in the input unit 28 has been turned on. When it is determined NO at step 601, CPU 21 repeatedly judges at step 602 if the tone-color designating switch has been turned on, until the tone-color designating switch is turned on. When it is determined at step 602 that the tone-color designating switch has been turned on (YES at step 602), CPU 21 associates information of a selected tone color with the sound generation area to store in an area/tone color table in RAM 26 (step 603). Then CPU 21 resets the area setting flag to "0" (step 604).

FIG. 8 is a view illustrating an example of the area/tone color table stored in RAM 26 in the first embodiment of the invention. As shown in FIG. 8, a record (for example, Reference numeral: 801) of the area/tone color table 800 has items such as an area ID, a coordinate of the center position C, a coordinate of the passing-through position P, a radius d, and a tone color. The area ID is prepared to uniquely specify the record in the table 800, and given by CPU 21 everytime one record of the area/tone color table 800 is generated. In the first embodiment of the invention, the area ID specifies the tone color of the percussion instruments. It is possible to arrange to specify the tone colors of musical instruments (keyboard instruments, string instruments, wind instruments and so on) other than the percussion instruments using the area ID.

Figure 9:
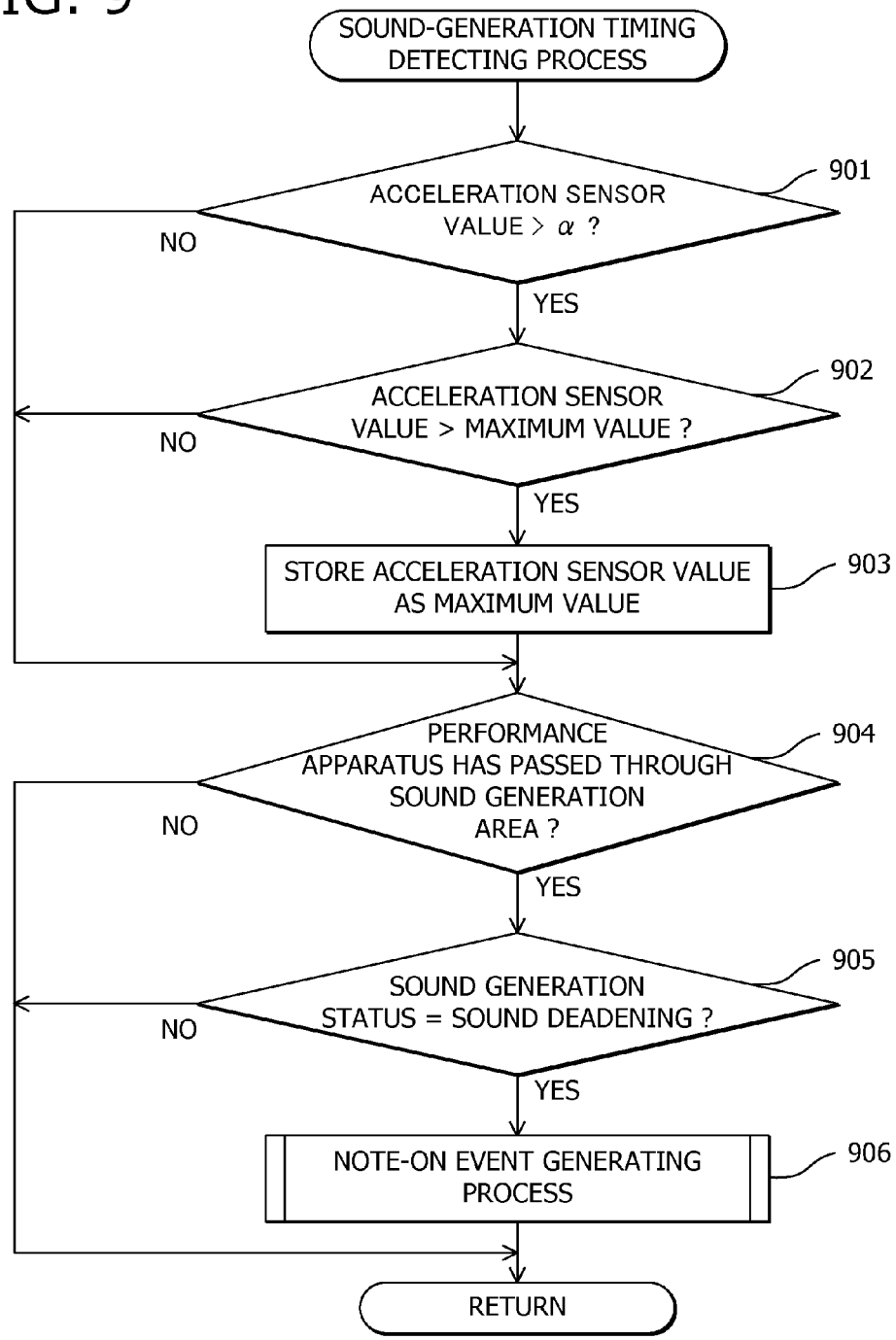
FIG. 9 is a flow chart of an example of a sound-generation timing detecting process performed in the performance apparatus according to the first embodiment of the invention.

When the tone-color setting process has finished at step 306 in FIG. 3, CPU 21 performs a sound-generation timing detecting process at step 307. FIG. 9 is a flow chart of an example of the sound-generation timing detecting process to be performed in the performance apparatus 11 according to the first embodiment of the invention.

CPU 21 judges at step 901 whether or not the acceleration sensor value obtained at step 302 is larger than a predetermined value. The predetermined value a may be an arbitrary value, which is larger than 0 and will do as long as it can be detected that the performance apparatus 11 is being swung by the player. When it is determined NO at step 901, the process advances to step 904. When it is determined YES at step 901, CPU 21 judges at step 902 whether or not the acceleration sensor value is larger than the maximum acceleration sensor value in RAM 26. When it is determined NO at step 902, the process advances to step 904.

When it is determined YES at step 902, CPU 21 stores in RAM. 26 the obtained acceleration sensor value as the maximum acceleration sensor value (step 903). Then, CPU 21 judges at step 904 whether the performance apparatus 11 has touched or passed through the sound generation area. More specifically, CPU 21 refers to the coordinate of the center position C, the coordinate of the passing-through position P, and the radius in each record of the area/tone color table to obtain the information, which specifies the plane of a circle defining the sound generation area, and CPU 21 judges at step 904 whether or not the current position of the performance apparatus 11 obtained from the sensor value of the geomagnetic sensor 22 in RAM 26 has touched the plane of sound generation area, or the path of the performance apparatus 11 obtained from the coordinates calculated in the previous process and the coordinates calculated in the current process intersects with the plane of sound generation area. When it is determined NO at step 904, then the sound-generation timing detecting process finishes.

When it is determined YES at step 904, CPU 21 judges at step 905 whether or not a sound generation status corresponding to the sound generation area, stored in RAM 26 is under a sound deadening operation. When it is determined YES at step 905, CPU 21 performs a note-on event generating process at step 906. In the first embodiment of the invention, the sound generation status is associated with each sound generation area and stored in RAM 26. In the sound source unit 31 of the musical instrument unit 19, the sound status indicates that a musical tone of a tone color associated with the sound generation area is sounding (sound generation status: sounding) or under sound deadening (sound generation status: sound deadening).

Figure 10:
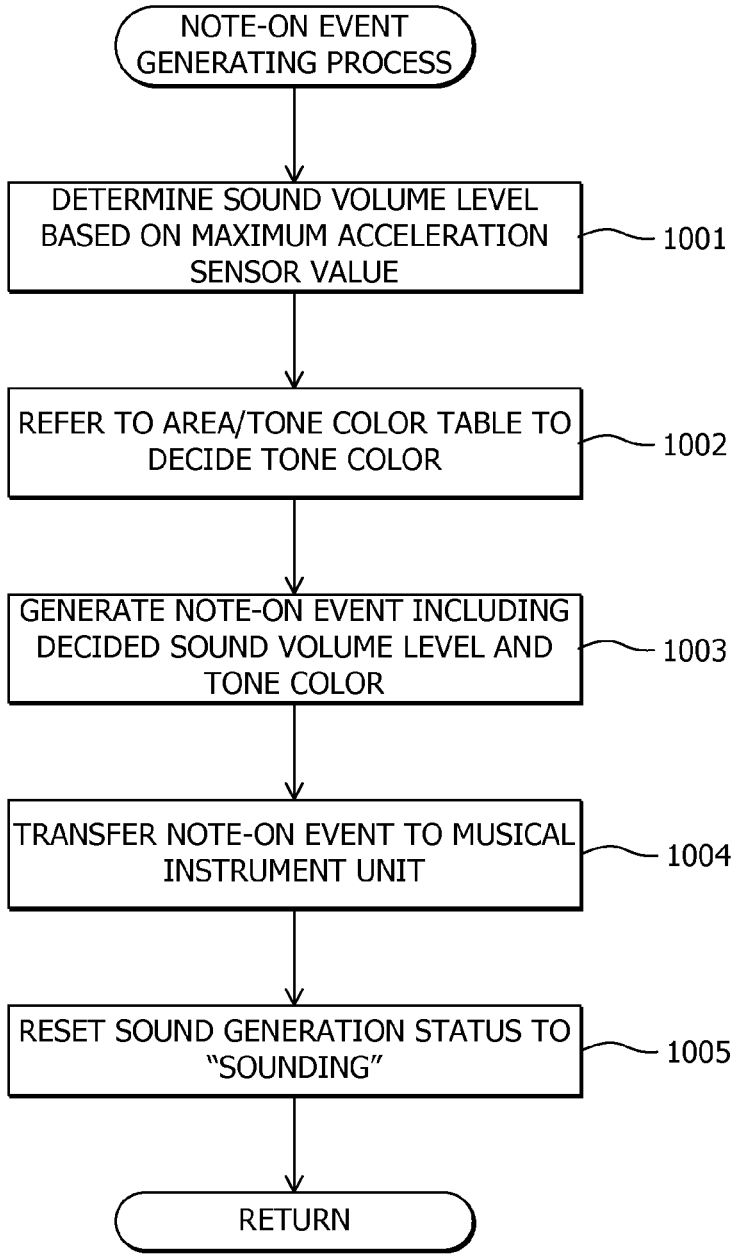
FIG. 10 is a flow chart of an example of a note-on event generating process performed in the performance apparatus according to the first embodiment of the invention.

FIG. 10 is a flow chart of an example of the note-on event generating process to be performed in the performance apparatus 11 according to the first embodiment of the invention. CPU 21 determines a sound volume level (velocity) based on the maximum acceleration sensor value stored in RAM 26 (step 1001).

Assuming that the maximum acceleration sensor value is denoted by Amax, and the maximum sound volume level (velocity) is denoted by Vmax, the sound volume level Vel will be expressed as follows:

$$Vel=a\times A\max,\ \text{where, if } a\times A\max>V\max,\ Vel=V\max$$
and "$a$" is a positive coefficient.

CPU 21 refers to the area/tone color table in RAM 26 to determine the tone color in the record with respect to the sound generation area corresponding to the position where the performance apparatus 11 is kept as the tone color of a musical tone to be generated (step 1002). Then, CPU 21 generates a note-on event including the determined sound volume level (velocity) and tone color (step 1003). A defined value is used as a pitch in the note-on event.

CPU 21 outputs the generated note-on event to I/F (step 1004). Further, I/F 27 makes the infrared communication device 24 send an infrared signal of the note-on event. The infrared signal is transferred from the infrared communication device 24 to the infrared communication device 33 of the musical instrument unit 19. Thereafter, CPU 21 resets the sound generation status in RAM 26 to "sounding" (step 1005).

When the sound-generation timing detecting process has finished at step 307 in FIG. 3, CPU 21 performs a parameter communication process at step 308. The parameter communication process (step 308) will be described together with a parameter communication process to be performed in the musical instrument unit 19 (step 1105 in FIG. 11).

Figure 11:
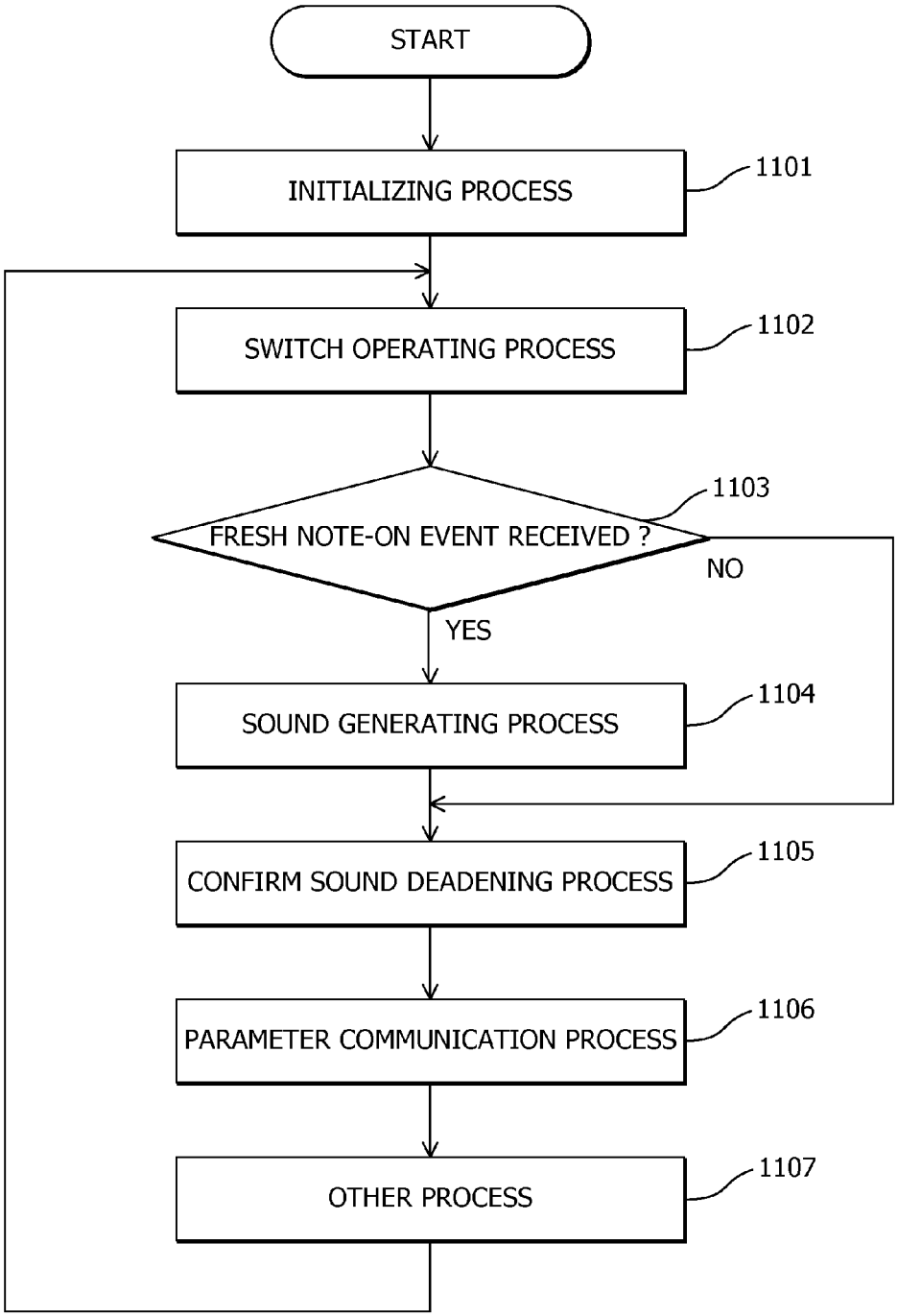
FIG. 11 is a flow chart of an example of a process performed in a musical instrument unit according to the first embodiment of the invention.

FIG. 11 is a flow chart of an example of a process to be performed in the musical instrument unit 19 according to the first embodiment of the invention. CPU 12 of the musical instrument unit 19 performs an initializing process at step 1101, clearing data in RAM 15 and an image on the display screen of the displaying unit 16 and further clearing the sound source unit 31. Then, CPU 12 performs a switch operating process at step 1102. In the switch operating process, CPU 12 sets parameters of effect sounds of a musical tone to be generated, in response to the switch operation on the input unit 17 by the player. The parameters of effect sounds (for example, depth of reverberant sounds) are stored in RAM 15. In the switch operating process, the area/tone color table transferred from the performance apparatus 11 and stored in RAM 15 of the musical instrument unit 19 can be edited by the switching operation. In the editing operation, the central positions and the radiuses of the sound generation areas can be modified and also the tone colors can be altered.

CPU 12 judges at step 1103 whether or not a fresh note-on event has been received through I/F 13. When it is determined YES at step 1103, CPU 12 performs a sound generating process at step 1104. In the sound generating process, CPU 12 sends the sound source unit 31 the received note-on event. The sound source unit 31 reads waveform data from ROM 14 in accordance with the tone color represented by the received note-on event. When the musical tones of tone colors of the percussion instruments are to be generated, the waveform data is read from ROM 14 at a constant rate. When the musical tones of tone colors of the musical instruments having pitches, such as the keyboard instruments, the wind instruments and the string instruments, are to be generated, the pitch follows the value included in the note-on event (in the first embodiment, the define value). The sound source unit 31 multiplies the waveform data by a coefficient based on the sound volume level (velocity) contained in the note-on event, generating musical tone data of a predetermined sound volume level. The generated musical tone data is supplied to the audio circuit 32, and a musical tone of the predetermined sound volume level is output through the speaker 35.

CPU 12 sees if musical tones are generated or not by the sound source unit 31 with respect to each of the tone colors, and when it is determined that the generation of musical tones has finished with respect to one tone color (sound deadening), CPU 12 stores in RAM 15 information representing "sound deadening" with respect to the tone color (step 1105). The information representing "sound deadening" is transferred to the performance apparatus 11 in the parameter communication process.

Then, CPU 12 performs the parameter communication process at step 1106. In the parameter communication process, CPU 12 gives an instruction to the infrared communication device 33 to transfer data of the area/tone color table edited by the switching operation (step 1102) to the performance apparatus 11. In the performance apparatus 11, when the infrared communication device 24 receives the data, CPU 21 receives the data through I/F 27 and stores the data in RAM 26 (step 308 in FIG. 3). The information representing "sound deadening" with respect to one tone color is transferred from the musical instrument unit 19 to the performance apparatus 11 (step 1106).

At step 308 in FIG. 3, CPU 21 of the performance apparatus 11 performs the parameter communication process. In the parameter communication process of the performance apparatus 11, data of the area/tone color table stored in RAM 26 is transferred from the performance apparatus 11 to the musical instrument unit 19, wherein the data is generated based on the sound generation area and tone color set at steps 305 and 306. In the parameter communication process of the performance apparatus 11, upon receipt of the information representing "sound deadening" with respect to one tone color from the musical instrument unit 19, CPU 21 alters the sound generation status with respect to the tone color in RAM 26 to "sound deadening".

When the parameter communication process of the musical instrument unit 19 has finished at step 1106 in FIG. 11, CPU 12 performs other process at step 1107. For instance, CPU 12 updates an image on the display screen of the displaying unit 16.

Figure 12:
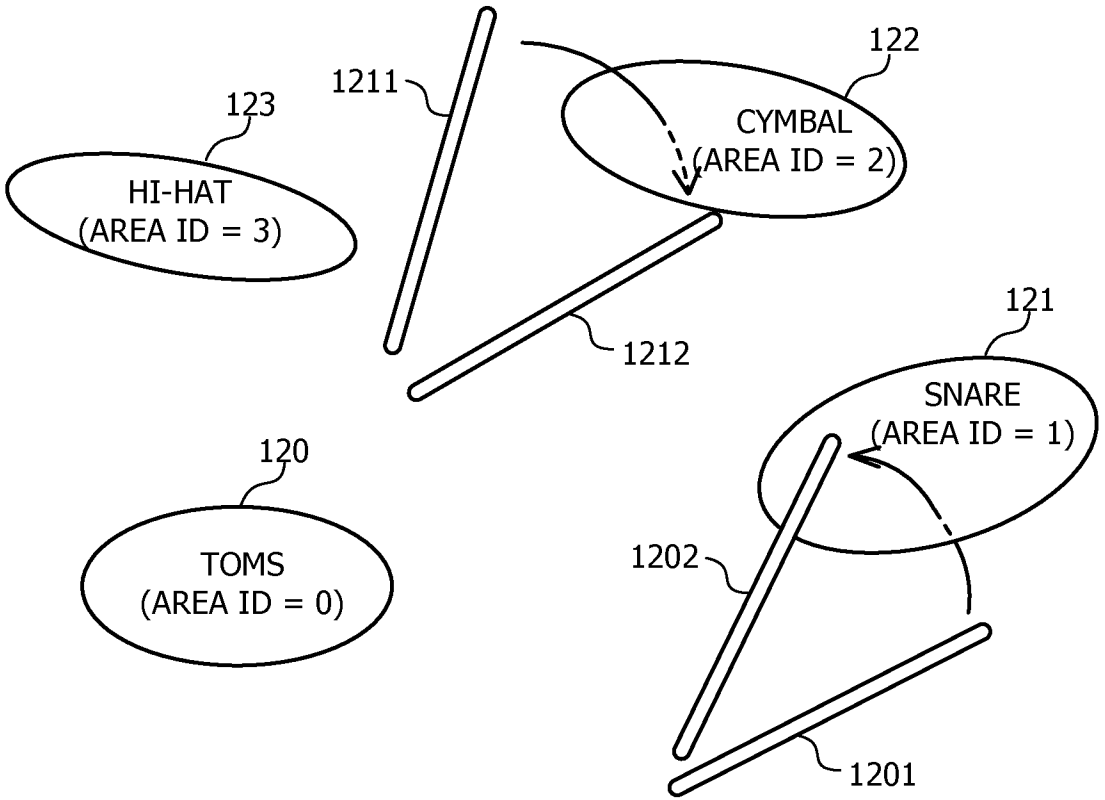
FIG. 12 is a view schematically illustrating examples of sound generation areas and corresponding tone colors set in the area setting process and the tone-color setting process performed in the performance apparatus according to the first embodiment of the invention.

FIG. 12 is a view schematically illustrating examples of sound generation areas and corresponding tone colors set in the area setting process and the tone-color setting process performed in the performance apparatus 11 according to the first embodiment of the invention. The examples shown in FIG. 12 correspond to the records of the areas/tone color table shown in FIG. 8. As shown in FIG. 12, four sound generation areas 120 to 123 are prepared. These sound generation areas 120 to 123 correspond to the area IDs 0 to 3 in the area/tone color table, respectively. When the player swings the performance apparatus (Reference numeral: 1201) down (or raises it up) and the head of the performance apparatus (Reference numeral: 1202) passes through the sound generation area 121, a musical tone having a tone color of a snare drum is generated. And when the player swings the performance apparatus (Reference numeral: 1211) down (or raises it up) and the head of the performance apparatus (Reference numeral: 1212)

passes through the sound generation area 122, a musical tone having a tone color of a cymbal is generated.

In the first embodiment of the invention, CPU 21 sets the sound generation timing at the time when the performance apparatus 11 has been placed in or passed through the sound generation area, and gives an instruction to the musical instrument unit 19 to generate a musical tone having a tone color corresponding to the above sound generation area at such sound generation timing. In this manner, musical tones can be generated having tone colors corresponding to the sound generation areas, each of which is an enclosed area in space.

In the first embodiment of the invention, the performance apparatus 11 is provided with the geomagnetic sensor 22 and the acceleration sensor 23. CPU 21 calculates the moving direction of the performance apparatus 11 based on the sensor value of the geomagnetic sensor 22, and also calculates the moving distance of the performance apparatus 11 based on the sensor value of the acceleration sensor 23. The current position of the performance apparatus 11 is obtained from the moving direction and the moving distance, whereby the position of the performance apparatus 11 can be found without using a large scale of equipment and performing complex calculations.

In the first embodiment of the invention, CPU 21 founds the maximum sensor value of the acceleration sensor 23, and calculates a sound volume level based on the maximum sensor value, and gives an instruction to the musical instrument unit 19 to generate a musical tone having the calculated sound volume level at the above sound generation timing. In the above manner, a musical tone can be generated with the player's desired sound volume level in respond to the player's swinging operation of the performance apparatus 11.

Further, in the first embodiment of the invention, based on the position information of a designated center position C and the position information of a position P other than the designated center position C, CPU 21 defines a plane of a circle having the center at the center position C and the circumference passing through the position P as the sound generation area, and stores a tone color associated with the information for specifying the sound area in the area/tone color table in RAM 26. In the manner described above, the player will be able to set the sound generation area having his or her desired size by specifying two positions.

Figure 13:
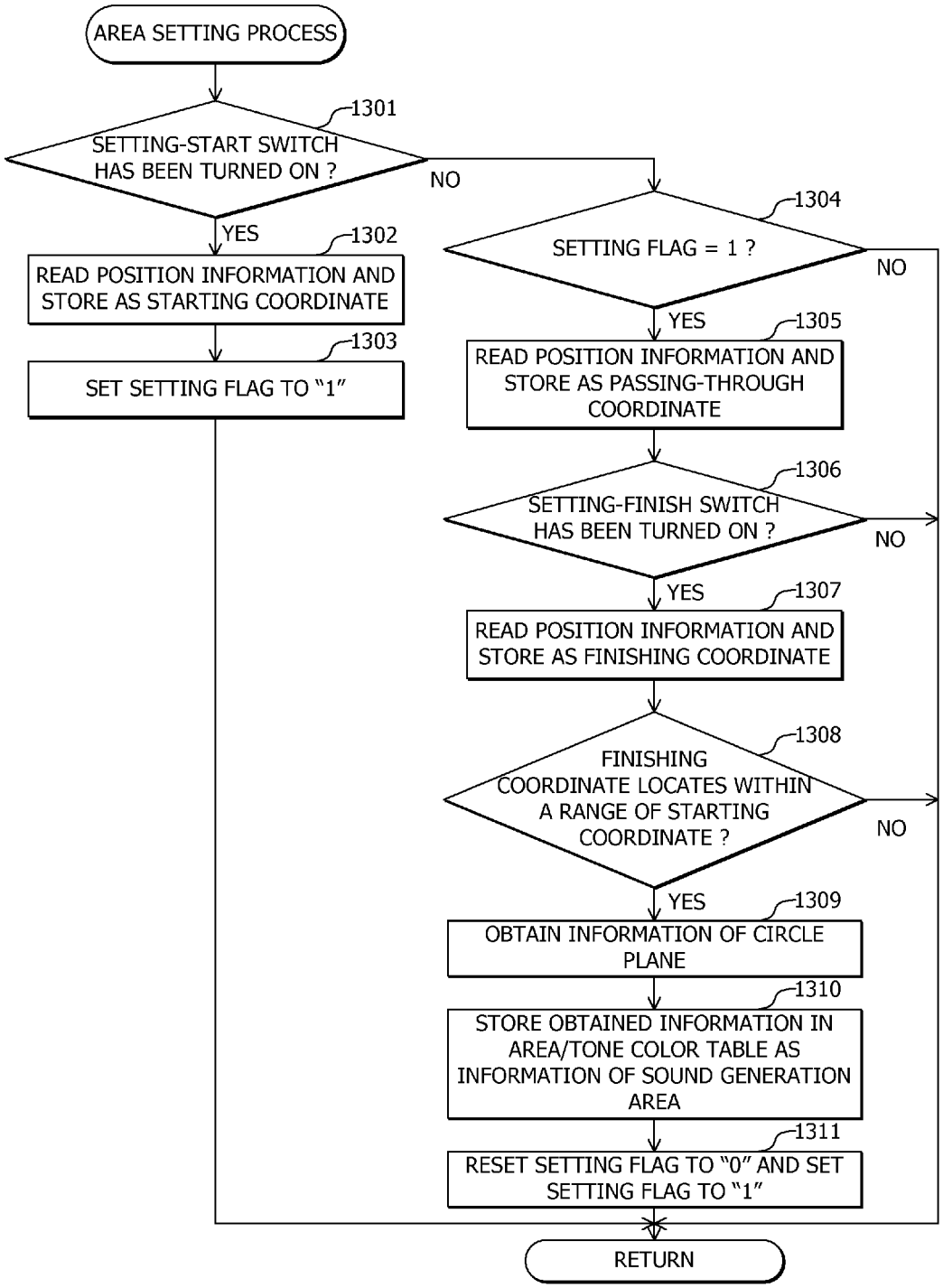
FIG. 13 is a flowchart of an example of the area setting process performed in the second embodiment of the invention.

Now, the second embodiment of the invention will be described. In the first embodiment of the invention, the center position C and the passing-through position P are set to define a circle of plane having the center at the center position C and the radius d (distance between the position C and the position P) passing through the passing-through position P, whereby the sound generation area of a circle plane is specified. Meanwhile, in the second embodiment of the invention, the player moves the performance apparatus 11 along his or her desired area in space to specify a circle or oval plane area. FIG. 13 is a flow chart of an example of the area setting process to be performed in the second embodiment of the invention. In the second embodiment of the invention, the input unit 28 of the performance apparatus 11 has a setting-start switch and a setting-finish switch.

CPU 21 judges at step 1301 whether or not the setting-start switch has been turned on. When it is determined YES at step 1301, CPU 21 reads the position information from RAM 26, and stores the position information as a coordinate (starting coordinate) of the starting position in RAM 26 (step 1302). CPU 21 sets a setting flag to "1" (step 1303).

When it is determined NO at step 1301, CPU 21 judges at step 1304 whether or not the setting flag has been set to "1". When it is determined YES at step 1304, CPU 21 reads the position information from RAM 26, and stores the position information as a coordinate (passing-through coordinate) of a passing-through position in RAM 26 (step 1305). The process at step 1305 is repeatedly performed plural times until the player turns on the setting-finish switch of the performance apparatus 11. Therefore, it is preferable to store in RAM 26 plural passing-through coordinates in association with the number of times of performance of the process at step 1305.

Thereafter, CPU 21 judges at step 1306 whether or not the setting-finish switch has been turned on. When it is determined YES at step 1306, CPU 21 reads the position information from RAM 26, and stores the position information as a coordinate (finishing coordinate) of a finishing position in RAM 26 (step 1307). Then, CPU 21 judges at step 1308 whether or not the finishing coordinate locates within a predetermined range of the starting coordinate. When it is determined NO at step 1308, then, the area setting process finishes. Similarly, when it is determined NO at steps 1304 and 1306, the area setting process finishes.

When it is determined YES at step 1308, based on the starting coordinate, the passing-through coordinate and the finishing coordinate, CPU 21 obtains information for specifying a plane of a circle or an oval passing through these coordinates (step 1309). CPU 21 creates a closed curve connecting coordinates adjacent to these coordinates, and obtains a circle or an oval closely related to the closed curve. A well known method such as the method of least squares is useful for obtaining the circle plane or oval plane. CPU 21 stores in the area/tone color table in RAM 26 the information representing the circle plane or oval plane as the information of sound generation area (step 1310). Thereafter, CPU 21 resets the setting flag to "0" and sets the area setting flag to "1" (step 1311).

Other processes to be performed in the second embodiment of the invention, such as the current position obtaining process and the sound-generation timing detecting process are performed substantially in the same manner as in the first embodiment of the invention. Also in the second embodiment of the invention, the player is allowed to set a circle or oval plane of his or her desired size as the sound generation area. Particularly in the second embodiment of the invention, the player can set the sound generation area having a substantially the same outline as a track, along which the performance apparatus 11 is moved.

Figure 14:
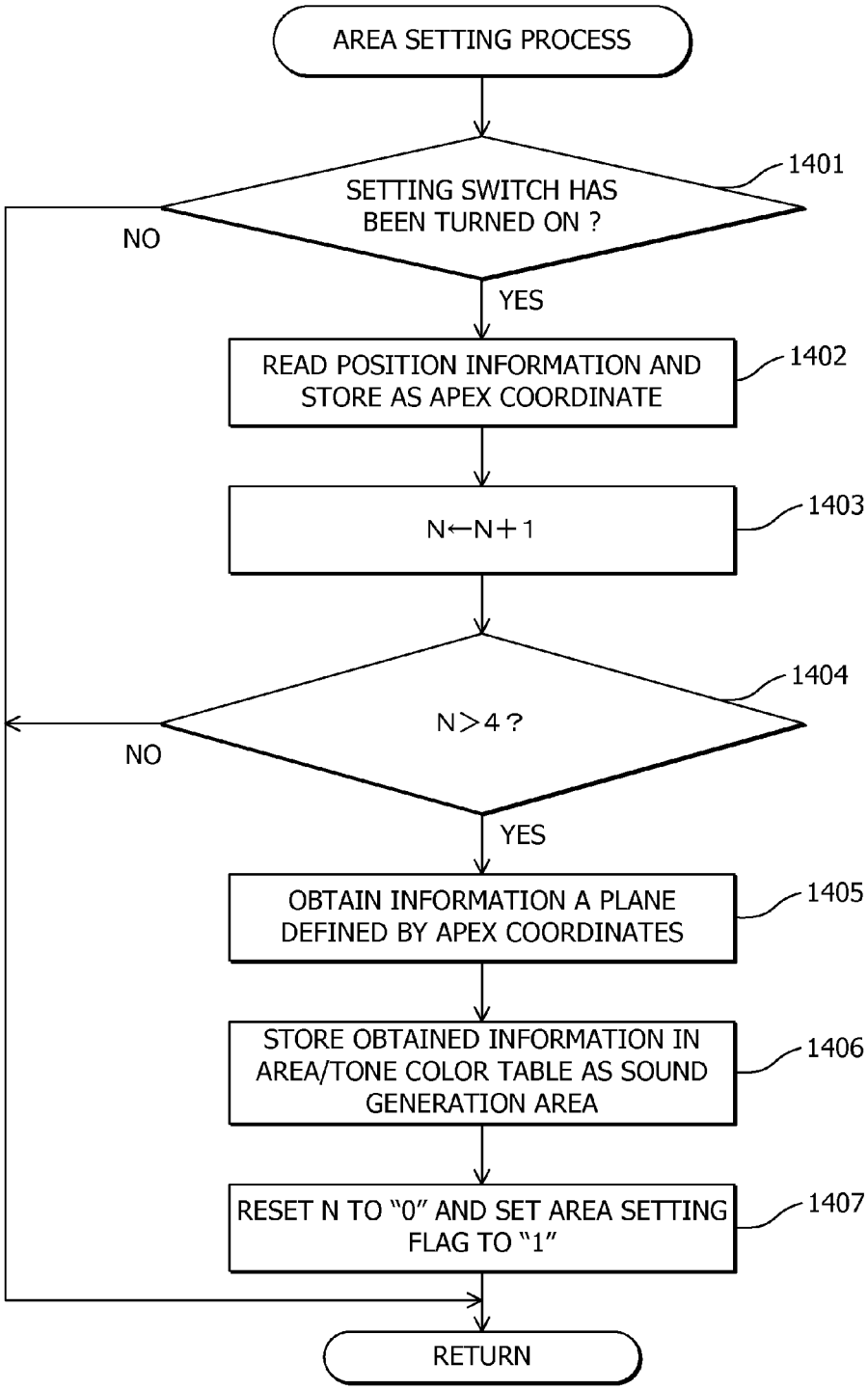
FIG. 14 is a flowchart of an example of the area setting process performed in the third embodiment of the invention.

Now, the third embodiment of the invention will be described. In the third embodiment of the invention, the player specifies plural apexes using the performance apparatus 11, and a plane surrounded by these apexes is set as the sound generation area. Hereinafter, the case where a quadrangle defined by four apexes is set as the sound generation area will be described. FIG. 14 is a flow chart of an example of the area setting process to be performed in the third embodiment of the invention.

CPU 21 judges at step 1401 whether or not the setting switch has been turned on. When it is determined YES at step 1401, CPU 21 reads the position information from RAM 26, and stores the position information as a coordinate of an apex (apex coordinate) in RAM 26 (step 1402). Then, CPU 21 increments a parameter N in RAM 26 (step 1403). The parameter N represents the number of apexes. In the third embodiment of the invention, the parameter N is reset to "0" in the initializing process (step 301 in FIG. 3). CPU 21 judges at step 1404 whether or not the parameter N is larger than "4". When it is determined NO at step 1404, the area setting process finishes.

When it is determined YES at step 1404, CPU 21 obtains information for specifying a plane (quadrangle) defined by four apex coordinates (step 1405). Then, CPU 21 stores the information representing the specified quadrangle in the area/tone color table in RAM 26 as the sound generation information (step 1406). CPU 21 initializes the parameter N in RAM 26 to "0" and sets the area setting flag to "1" (step 1407).

In the third embodiment of the invention, the player specifies plural apexes and a sound generation area consisting of the area defined by these apexes can be set. In the third embodiment of the invention, a plane (quadrangle) defined by four apexes is set as the sound generation area, but the number of apexes can be changed. For example, a polygon such as a triangle can be set as the sound generation area.

Now, the fourth embodiment of the invention will be described. In the first to third embodiments of the invention, every sound generation area is assigned with a corresponding tone color, and the information for specifying the sound generation area associated with the information of tone color is stored in the area/tone color table. When the performance apparatus 11 passes through the sound generation area, a tone color of a musical tone to be generated is determined on the basis of the area/tone color table. In the fourth embodiment of the invention, every sound generation area is assigned with a corresponding pitch. When the performance apparatus 11 passes through a sound generation area, a musical tone of a pitch corresponding to the sound generation area is generated. This arrangement will be appropriate for generating musical tones of the tone colors, such as musical tones of the percussion instruments, for example, musical tones of marimbas and vibraphones.

Figure 15:
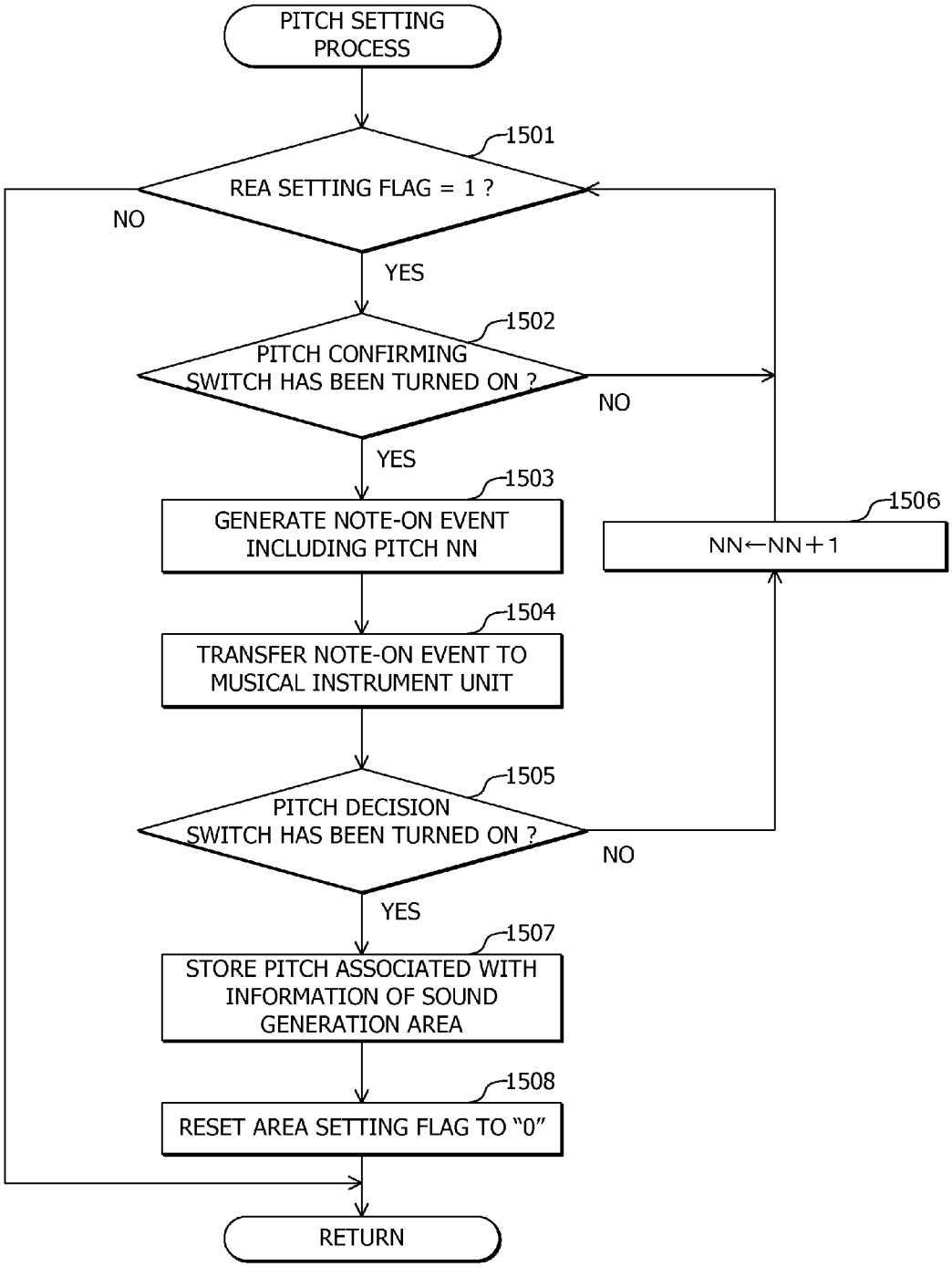
FIG. 15 is a flow chart of an example of a pitch setting process performed in the fourth embodiment of the invention.

In the fourth embodiment of the invention, a pitch setting process is performed in place of the tone-color setting process (step 306) in the process shown in FIG. 3. FIG. 15 is a flow chart of an example of the pitch setting process to be performed in the fourth embodiment of the invention. In the fourth embodiment of the invention, any one of the area setting processes in the first to third embodiments can be employed. In the fourth embodiment of the invention, the input unit 28 has a pitch confirming switch and a pitch decision switch. A parameter NN representing a pitch (pitch information in accordance with MIDI) is set to an initial value (for example, the lowest pitch) in the initializing process. CPU 21 judges at step 1501 whether or not the area setting flag has been set to "1". When it is determined NO at step 1501, then the pitch setting process finishes.

When it is determined YES at step 1501, CPU 21 judges at step 1502 whether or not the pitch confirming switch has been turned on. When it is determined YES at step 1502, CPU 21 generates a note-on event including pitch information in accordance with the parameter NN representing a pitch (step 1503). The note-on event can include information representing a sound volume and a tone color determined separately. CPU 21 outputs the generated note-on event to I/F 27 (step 1504). Further, I/F 27 makes the infrared communication device 24 transfer an infrared signal of the note-on event. The infrared signal of the note-on event is transferred from the infrared communication device 24 to the infrared communication device 33 of the musical instrument unit 19, whereby the musical instrument unit 19 generates a musical tone having a predetermined pitch.

Then, CPU 21 judges at step 1505 whether or not the pitch decision switch has been turned on. When it is determined NO at step 1505, CPU 21 increments the parameter NN representing a pitch (step 1506) and returns to step 1502. When it is determined YES at step 1505, CPU 21 associates the parameter NN representing a pitch with the information of sound generation area to store in an area/pitch table in RAM 26 (step 1507). Then, CPU 21 resets the area setting flag to "0" (step 1508).

In the pitch setting process shown in FIG. 15, every time the pitch confirming switch is turned on, a musical tone of one pitch higher than the last tone is generated. When a musical tone of a pitch desired by the player is generated, the player turns on the pitch decision switch to associate his or her desired pitch with the sound generation area. In the fourth embodiment of the invention, the area/pitch table in RAM 26 has substantially the same items as that shown in FIG. 8. In the area/tone color table shown in FIG. 8, the area ID and the information for specifying the sound generation area (in the case of FIG. 8, center position C, passing-through position P and radius d) are associated with the tone color. In the area/pitch table of the fourth embodiment, the area ID and the information for specifying the sound generation area are associated with the pitch.

Figure 16:
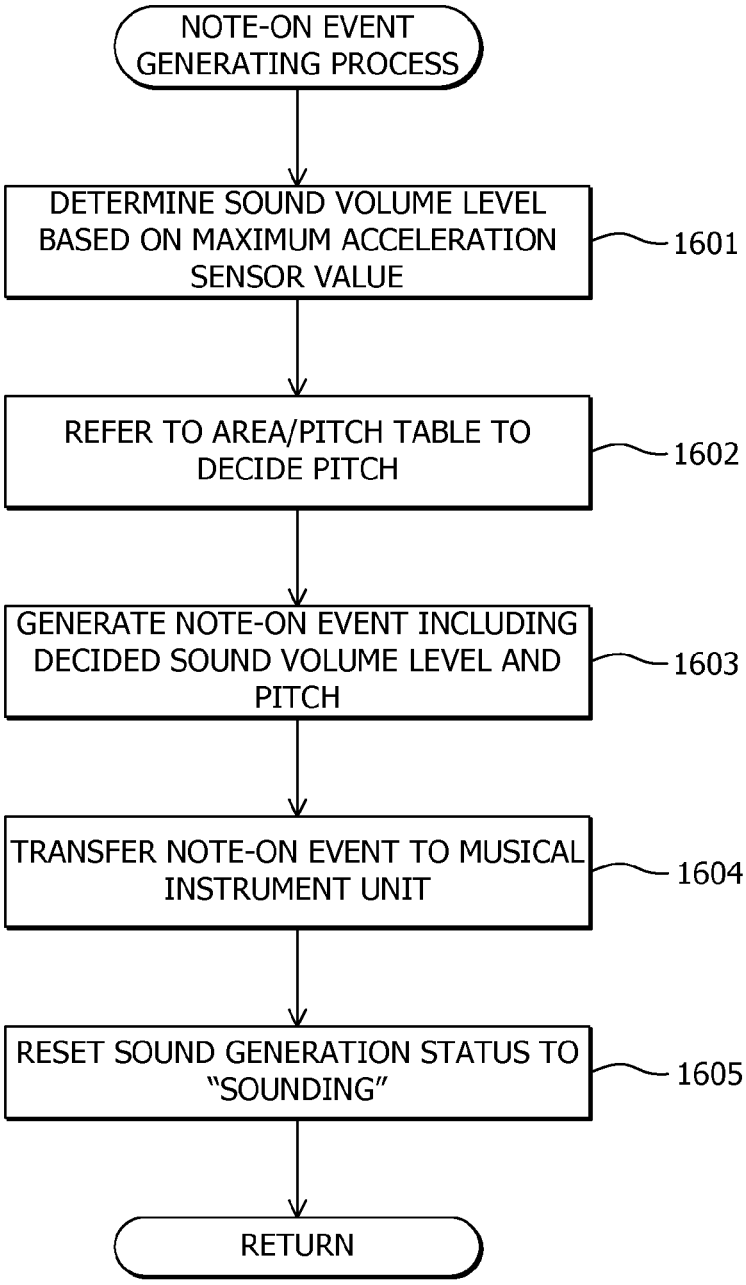
FIG. 16 is a flow chart of an example of a note-on event generating process performed in the fourth embodiment of the invention.

In the fourth embodiment of the invention, the sound-generation timing detecting process is performed as in the first to the third embodiments (Refer to FIG. 9), and the note-on event generating process is performed. FIG. 16 is a flow chart of an example of the note-on event generating process to be performed in the fourth embodiment of the invention. The process at step 1601 in FIG. 16 is substantially the same as the process at step 1001 in FIG. 10. CPU 21 refers to the area/pitch table in RAM 26 to read a pitch in the record corresponding to the sound generation area, where the performance apparatus 11 is located, and determines the read pitch as the pitch of a musical tone to be generated (step 1602). CPU 21 generates a note-on event including the decided sound volume level (velocity) and pitch (step 1603). In the note-on event, the tone color will be set to a defined value. The processes at steps 1604 and 1605 correspond respectively to those at steps 1004 and 1005 in FIG. 10. In this way, the musical tone having the pitch corresponding the sound generation area can be generated.

Figure 17:
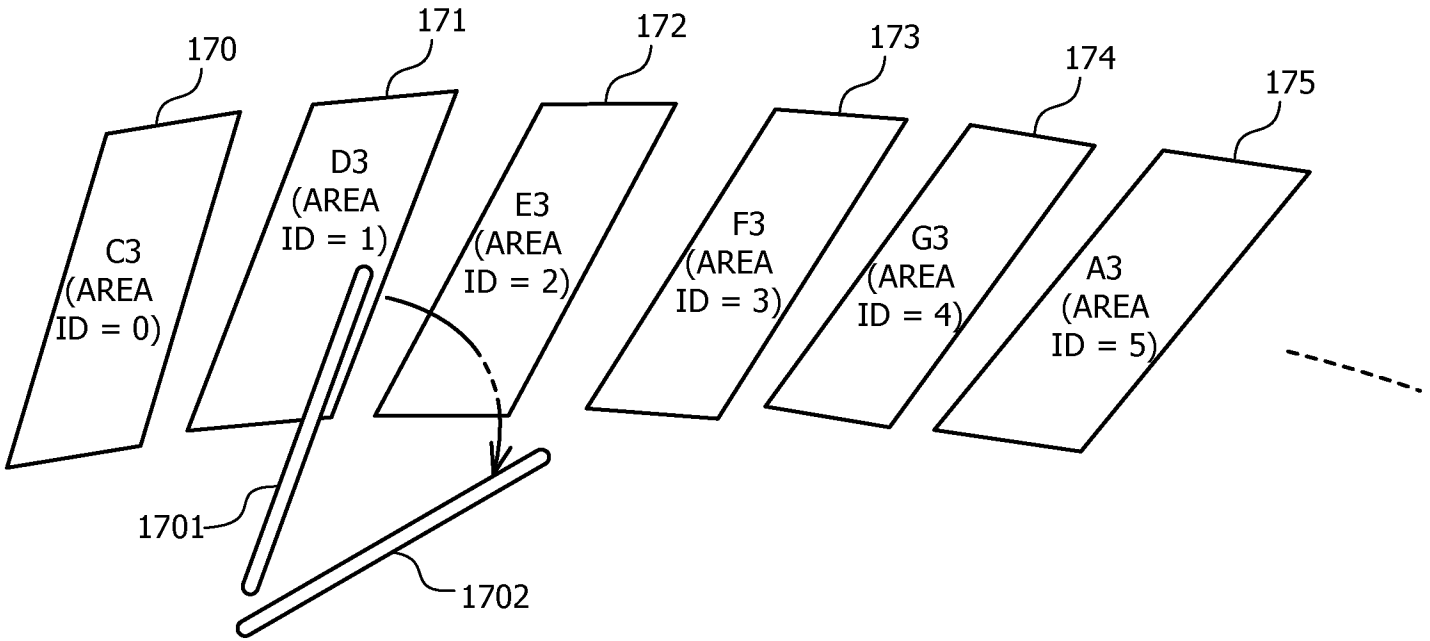
FIG. 17 is a view schematically illustrating an example of the sound generation areas and corresponding pitches set in the area setting process and the pitch setting process in the fourth embodiment of the invention.

FIG. 17 is a view schematically illustrating an example of the sound generation areas and corresponding pitches set in the area setting process and the pitch setting process in the fourth embodiment of the invention. In the area setting process, quadrangles are set as the sound generation areas like in the third embodiment. In FIG. 17, 6 sound generation areas 170 to 175 of a quadrangle defined by four apexes are shown. Further, the sound generation areas 170 to 175 are given the area IDs "0" to "5", respectively. The sound generation areas 170 to 175 are assigned pitches C3, D3, E3, F3, G3 and A3, respectively. The above information is stored in the area/pitch table in RAM. 26. For example, when the player sings the performance apparatus (Reference numeral: 1701) down, and when the head of the performance apparatus (Reference numeral: 1702) passes through the sound generation area 172, a musical tone having the pitch E3 corresponding to the sound generation area 172 is generated.

In the fourth embodiment of the invention, the sound generation areas are assigned with respective pitches, and when the performance apparatus 11 passes through one sound generation area, then a musical tone having a pitch corresponding to such sound generation area is generated. Therefore, the fourth embodiment of the invention can be used to generate musical tones of desired pitches as if the percussion instruments such as marimbas and vibraphones are played.

The present invention has been described with reference to the accompanying drawings and the first to fourth embodiments, but it will be understood that the invention is not limited to these particular embodiments described herein, and numerous arrangements, modifications, and substitutions may be made to the embodiments of the invention described herein without departing from the scope of the invention.

In the embodiments described above, CPU 21 of the performance apparatus 11 detects an acceleration sensor value and a geomagnetic sensor value while the player swings the performance apparatus 11, and obtains the position information of the performance apparatus 11 from these sensor values to judges whether or not the performance apparatus 11 has contacted with or passed through the sound generation area. When it is determined that the performance apparatus 11 has contacted with or passed through the sound generation area, then, CPU 21 of the performance apparatus 11 generates a note-on event including the tone color corresponding to the sound generation area (in the first to third embodiments) or the pitch corresponding to the sound generation area (in the fourth embodiment), and transfers the generated note-on event to the musical instrument unit 19 through I/F 27 and the infrared communication device 24. Meanwhile, receiving the note-on event, CPU 12 of the musical instrument unit 19 supplies the received note-on event to the sound source unit 31, thereby generating a musical tone. The above arrangement is preferably used in the case that the musical instrument unit 19 is a device not specialized in generating musical tones, such as a personal computer and/or a game machine provided with a MIDI board.

The processes to be performed in the performance apparatus 11 and the processes to be performed in the musical instrument unit 19 are not limited to those described in the above embodiments. For example, an arrangement can be made such that the performance apparatus 11 transfers information of the area/tone color table to the musical instrument unit 19, or obtains the position information of the performance apparatus 11 from the sensor values and transfers the obtained position information to the musical instrument unit 19. In the arrangement, the sound-generation timing detecting process (FIG. 9) and the note-on event generating process (FIG. 10) are performed in the musical instrument unit 19. The arrangement is suitable for use in electronic musical instruments, in which the musical instrument unit 19 is used as a device specialized in generating musical tones.

Further, in the embodiments, the infrared communication devices 24 and 33 are used for the infrared signal communication between the performance apparatus 11 and the musical instrument unit 19 to exchange data between them, but the invention is not limited to the infrared signal communication. For example, data can be exchanged between percussion instruments 11 and the musical instrument unit 19 by means of radio communication and/or wire communication in place of the infrared signal communication through the devices 24 and 33.

In the embodiment, the moving direction of the performance apparatus 11 is detected by the geomagnetic sensor 23, and the moving distance of the performance apparatus 11 is calculated by the acceleration sensor 22, and the position of the performance apparatus 11 is obtained based on the moving direction and the moving distance. The method of obtaining the position of the performance apparatus 11 is not limited to the above, but the position of the performance apparatus 11 can be obtained using sensor values of a tri-axial acceleration sensor and a sensor value of an angular rate sensor.

What is claimed is:

1. A performance apparatus comprising:

a holding member held by a player with his or her hand;

a musical-tone generating unit for generating musical tones;

an area/parameter storing unit for storing information for specifying plural sound generation areas defined in space and parameters of musical tones corresponding respectively to the plural sound generation areas;

a position-information obtaining unit for successively obtaining position information of the holding member, wherein the position-information obtaining unit comprises a geomagnetic sensor and an acceleration sensor, and detects a moving direction of the holding member from a sensor value from the acceleration sensor and calculates a moving distance of the holding member from a sensor value from the geomagnetic sensor;

a sound-generation detecting unit for detecting whether or not the position information of the holding member obtained by the position-information obtaining unit is included in any of the plural sound generation areas specified by the information stored in the area/parameter storing unit;

a reading unit for reading from the area/parameter storing unit the parameter corresponding to the sound generation area, in which the sound-generation detecting unit determines the position information of the holding member is included;

an instructing unit for giving an instruction to the musical-tone generating unit to generate a musical tone specified by the parameter read by the reading unit at a timing of sound generation, wherein the timing of sound generation is set to a time when the sound-generation detecting unit has detected that the position information of the holding member is included in the sound generation area; and a sound volume level calculating unit for detecting the maximum sensor value of the acceleration sensor, and for calculating a sound volume level of a musical tone corresponding to the detected maximum sensor value, wherein the instructing unit gives an instruction to the musical-tone generating unit to generate a musical tone having the sound volume level calculated by the sound volume level calculating unit.

2. The performance apparatus according to claim 1, wherein the sound generation area is a plane of a circle specified in space, and after specifying any one of plural pieces of position information of the holding member obtained by the position-information obtaining unit as position information of a central position of the circle, said sound generation area is defined by specifying another piece of position information among the plural pieces of position information of the holding member.

3. The performance apparatus according to claim 1, wherein the sound generation area is specified by a track represented by plural pieces of position information of the holding member successively obtained at predetermined time intervals by the position-information obtaining unit.

4. The performance apparatus according to claim 1, wherein the sound generation area is a plane defined by lines connecting not less than three apexes, wherein as the apexes are set the plural pieces of position information of the holding member are successively obtained by the position-information obtaining unit.

5. The performance apparatus according to claim 1, wherein the parameter is a tone color.

6. The performance apparatus according to claim 1, wherein the parameter is a pitch.

7. An electronic musical instrument comprising:

a performance apparatus; and a musical instrument unit having a musical-tone generating unit for generating musical tones;

wherein the performance apparatus comprises:

a holding member held by a player;

an area/parameter storing unit for storing information for specifying plural sound generation areas defined in space and parameters of musical tones corresponding respectively to the plural sound generation areas;

a position-information obtaining unit for successively obtaining position information of the holding member, wherein the position-information obtaining unit comprises a geomagnetic sensor and an acceleration sensor, and detects a moving direction of the holding member from a sensor value from the acceleration sensor and calculates a moving distance of the holding member from a sensor value from the geomagnetic sensor;

a sound-generation detecting unit for detecting whether or not the position information of the holding member obtained by the position-information obtaining unit is included in any of the plural sound generation areas specified by the information stored in the area/parameter storing unit;

a reading unit for reading from the area/parameter storing unit the parameter corresponding to the sound generation area, in which the sound-generation detecting unit determines the position information of the holding member is included, an instructing unit for giving an instruction to the musical-tone generating unit to generate a musical tone specified by the parameter read by the reading unit at a timing of sound generation detected by the sound-generation detecting unit, wherein the timing of sound generation is set to a time when the sound-generation detecting unit has detected that the position information of the holding member is included in the sound generation area; and a sound volume level calculating unit for detecting the maximum sensor value of the acceleration sensor, and for calculating a sound volume level of a musical tone corresponding to the detected maximum sensor value, wherein the instructing unit gives an instruction to the musical-tone generating unit to generate a musical tone having the sound volume level calculated by the sound volume level calculating unit; and wherein both the performance apparatus and the musical instrument unit comprise communication units, respectively.

* * * * *

UNITED STATES PATENT AND TRADEMARK OFFICE

CERTIFICATE OF CORRECTION

PATENT NO. : 8,586,853 B2
APPLICATION NO. : 13/306257
DATED : November 19, 2013
INVENTOR(S) : Naoyuki Sakazaki It is certified that error appears in the above-identified patent and that said Letters Patent is hereby corrected as shown below:

In the Specification

Column 1, Line 9:

delete "Nov" and insert --Dec--.

In the Claims

Column 18, Line 2:

delete "included," and insert --included;--.

Signed and Sealed this
Second Day of September, 2014

Michelle K. Lee

Michelle K. Lee
*Deputy Director of the United States Patent and Trademark Office*